US006764260B1

(12) United States Patent
Nebesnak et al.

(10) Patent No.: US 6,764,260 B1
(45) Date of Patent: Jul. 20, 2004

(54) PLASTIC/METAL COMPOSITE BATTEN BAR AND METHOD OF USING SAME FOR SECURING A THERMOPLASTIC ROOF MEMBRANE TO A ROOF DECK

(75) Inventors: Edward Nebesnak, Mine Hill, NJ (US); William P. Kuhn, Boonton, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/375,249

(22) Filed: Feb. 27, 2003

(51) Int. Cl.[7] ..... F16B 27/00; F16B 39/02

(52) U.S. Cl. ..... 411/82; 411/84; 411/258; 411/930; 411/966; 52/410

(58) Field of Search ..... 411/82, 84, 85, 411/258, 531, 930, 966; 52/410, 512

(56) References Cited

U.S. PATENT DOCUMENTS

| | | | | |
|---|---|---|---|---|
| 4,737,213 A | | 4/1988 | Paeglis et al. | 156/157 |
| 4,747,241 A | * | 5/1988 | Whitman | 411/531 X |
| 4,787,188 A | | 11/1988 | Murphy | 52/410 |
| 5,049,018 A | | 9/1991 | Murphy | 411/488 |
| 5,110,398 A | | 5/1992 | Murphy | 156/499 |
| 5,163,798 A | | 11/1992 | McGovern | 411/448 |
| 5,572,843 A | * | 11/1996 | Jordan | 52/410 |
| 5,800,891 A | * | 9/1998 | Wasitis | 52/410 X |
| 6,004,645 A | * | 12/1999 | Hubbard | 52/410 X |
| 6,338,232 B1 | * | 1/2002 | Yamanaka et al. | 52/410 X |
| 6,640,511 B1 | * | 11/2003 | Link | 52/410 |

* cited by examiner

*Primary Examiner*—Neill Wilson
(74) *Attorney, Agent, or Firm*—Imre Balogh; William J. Davis

(57) ABSTRACT

Two-piece fastener assembly for securing thermoplastic roof membranes to an underlying roof deck having: a batten bar coated with a thermoplastic coating on its top surface; a plurality of openings in the batten bar; and fasteners positioned in the plurality of openings for securing the batten bar and one thermoplastic roof membrane to the underlying roof deck. In a method aspect the steps of securing thermoplastic roof membranes to an underlying roof deck includes: placing a first thermoplastic roof membrane on the roof deck; placing a batten bar on the marginal portion of the first thermoplastic roof membrane and securing the batten bar along with the first thermoplastic roof membrane to the roof deck by use of the fasteners; placing a second thermoplastic roof membrane to overlap the batten bar and the marginal portion of the first thermoplastic roof membrane; and applying heat and pressure to the batten bar and the overlapped portion of the first and second thermoplastic roof membranes to fuse them together and provide a waterproof covering over the roof deck.

10 Claims, 3 Drawing Sheets

PLASTIC/METAL COMPOSITE BATTEN BAR AND METHOD OF USING SAME FOR SECURING A THERMOPLASTIC ROOF MEMBRANE TO A ROOF DECK

BACKGROUND OF THE INVENTION

Field of the Invention

The present invention relates to fasteners employed to fasten a covering material to an underlying substrate. More particularly, the invention relates to a plastic/metal composite batten bar with a fastener for fastening a membrane, such as a roof membrane or roofing insulation, to a roof deck.

Reported Development

Fasteners are conventionally employed in the building industry for fastening or clamping a flexible membrane, such as an insulation membrane to a substrate, such as a roof deck. The fasteners typically comprise a large head portion and a shank portion. In use, the shank portion is driven through the membrane into the underlying substrate to anchor the fastener thereinto, while the head portion holds the membrane against the substrate and prevent removal thereof by wind lift. The undersurface of the head portion is typically provided with gripping means so that the membrane is prevented from moving or sliding under the fastener. Conventional fasteners are illustrated by the following references.

U.S. Pat. No. 4,787,188 discloses a stress plate for securing a roof membrane to a roof deck. The stress plate is circular having a top surface and a bottom surface with a central circular opening for receiving a screw for fastening the stress plate over a roof membrane and to the roof deck. The stress plate is equipped with four gripping prongs of triangular shape which are circumferentially spaced from each other by 90°.

In use a first membrane is applied to a roof deck surface, then the membrane is secured to the roof deck surface with the stress plate and the screw. A top sheet or membrane is lapped over the first membrane to cover the stress plate and welded to the first membrane. The four gripping prongs in the stress plate grip the first sheet and hold the same on top of the roof deck without tearing.

U.S. Pat. No. 5,049,018 discloses a fastener for gripping a substrate material. The fastener is of a unitary piece comprising a head portion, a shaft portion, and a hook portion at the end of the shaft portion, wherein the hook portion has an outwardly and upwardly extending resilient end portion. The end portion has an end surface which provides gripping contact with a wall of a hole in a substrate into which the fastener is inserted.

U.S. Pat. No. 5,163,798 relates to a fastener assembly which is employed to secure plies or membranes of roofing, felt and paper to prevent the materials from being blown off the base roofing material before the base material is sufficiently hardened.

The assembly comprises a fastener and a retainer plate. The assembly includes a fastener plate which defines a substantially rectangular opening. The fastener includes a head and a pair of legs which are integrally hingably connected to the head. The legs have a contoured distal portion and an angular side configuration so that at least one of the legs is forced apart as the fastener is driven into the base material.

We have observed that under windy conditions the prior art fasteners need improvement in securely holding a flexible membrane on a substrate without the gripping means penetrating the flexible membrane, and without tearing the flexible membrane.

Asphalt roof membranes to prevent moisture from entering into an underlying roof deck are being replaced by thermoplastic sheet materials which offer a superior, longer-lasting roof at a lower cost. In the process of installing thermoplastic sheet materials over a roof deck, the typical steps are as follows. A first sheet is laid adjacent to the lower edge of the roof and running parallel thereto. Fastening means, such as batten bar or a line of stress plates are positioned near the upper edge of the first sheet. Fasteners are inserted through the batten bar or stress plates and into the roof deck to securely hold the first sheet to the roof deck. Then a second sheet is laid over the roof deck in a marginally overlapping relationship with the first sheet. The second sheet also overlaps the batten bar or the line of stress plates. The overlapping edge area of the second sheet overlaps the area of the first sheet on both sides of the batten bar or line of stress plates. A weld is then applied between the first sheet and the second sheet resulting in the fusion of the two sheets on both sides of the batten bar or the line of stress plates. The weld is applied by the use of a welding machine or tool which softens the thermoplastic sheets and, after cooling, solidifies and forms a continuous sheet. The steps are repeated until the roof deck is completely covered by the thermoplastic sheets.

It has been observed that stress plates having a high profile create bumps in the weld area. It has also been observed that stress plates made of metals and a plastic that is not heat weldable do not adhere to the second or overlapping thermoplastic sheet thereby creating bubbles in the weld. Accordingly, it is an object of the present invention to provide a batten bar which substantially remains in the plane of the thermoplastic sheets and which is coated with a thermoplastic material so that the second or overlapping sheet is also welded to the batten bar.

This aspect will be addressed as the description of the invention proceeds, followed by a method of using the batten bar for fusing thermoplastic sheets over a roof deck.

SUMMARY OF THE INVENTION

In a device aspect, the present invention comprises a metal batten bar having a top surface and a bottom surface coated with a thermoplastic material on the top surface thereof. The composition of the batten bar consists of a metal, such as steel, galvalum or galvanized metals preferably having a thickness of about 0.25 to 3 mm, and a thermoplastic layer preferably having a thickness of about 0.25 mm to 2 mm. Softer metals such as copper and aluminum may also be used, however, the thickness of the batten bar should be larger to provide sufficient integrity to the batten bar. The thermoplastic material coating the batten bar may be polyvinyl chloride, thermoplastic olefins, chlorinated polyethylene, chlorosulfonated polyethylene, nylon, ethylene propylene diene rubber or any other heat weldable thermoplastic composition. The batten bar is provided with openings at 6" or more intervals to allow fasteners therethrough, such as screws for securing the same to thermoplastic sheets and the underlying roof deck insulation and/or cover board. The fastener is preferably a screw member having threads thereon. The thermoplastic material must be compatible with the thermoplastic roofing membrane i.e., it must fuse thereto upon the application of heat and pressure.

In the method aspect, the present invention comprises the steps of:

a) laying a first thermoplastic sheet or membrane on a portion of the roof deck;

b) laying a batten bar near the edge of the thermoplastic sheet or membrane parallel to the edge;

c) securing the first thermoplastic sheet or membrane on the roof deck by inserting fasteners through the batten bar, the first thermoplastic sheet or membrane and into the roof deck insulation and/or cover board;

d) laying a second thermoplastic sheet or membrane on the roof deck in an overlapping relationship to the batten bar and the first thermoplastic sheet or membrane; and e) applying heat and pressure to the overlapped portion of the thermoplastic sheets or membranes on both sides of the batten bar and over the batten bar thereby causing a fusion of the thermoplastic sheets or membranes and to the batten bar.

The heat weld may be accomplished by a welding machine known in the art, such as described in U.S. Pat. Nos. 4,259,142, 4,289,552, 4,440,588, 4,533,423, 4,861,412, 4,894,112, 5,110,398, and 5,935,357. However, we prefer to use a welding machine which is disclosed in co-pending application Ser. No. 09/190,373 and comprises a pressure roller and a heating element for a welding apparatus for producing a weld simultaneously on each side of a line of fasteners and over the fasteners. The pressure roller is integral with an axle designed to be connected to a driving means at one end thereof; at the other end of the axle the pressure roller comprises a distal end, a proximal end and a center portion which defines a groove between the proximal and distal ends. The groove of the pressure roller carries an elastomeric cushion designed to smoothly ride over a line of fastening means.

The pressure roller is used in combination with a heating element containing a blower which forces heated air through a nozzle. The nozzle having an outlet therein preferably comprises three portions: two large opening portions and a restricted opening portion therebetween. In use, the large opening portions allow delivery of the major portion of the hot air produced by the heating element while the restricted opening still allows delivery of sufficient amounts of the heated air to soften the overlapping portions of the thermoplastic sheet over and under the fastening means.

DESCRIPTION OF THE PREFERRED EMBODIMENTS

Reference is now made to the drawings which illustrate the present invention.

Figure 1:
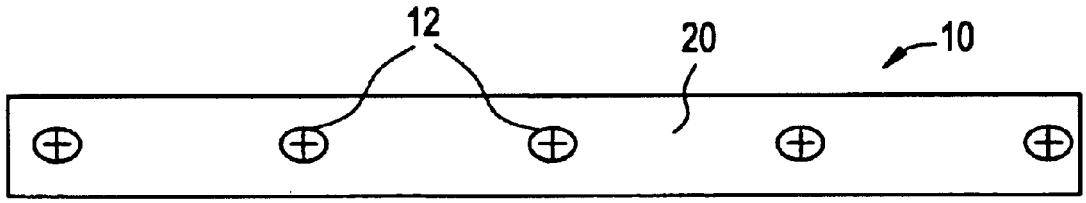
FIG. 1 is a top, plan view of the batten bar without fasteners.

FIG. 1 shows a top plan view of the batten bar without fasteners, generally designated at 10, having en elongated rectangular configuration or strip of uniform width. The batten bar is provided with openings or holes 12 to allow fasteners therethrough for securing the batten bar to an underlying surface.

Figure 2:
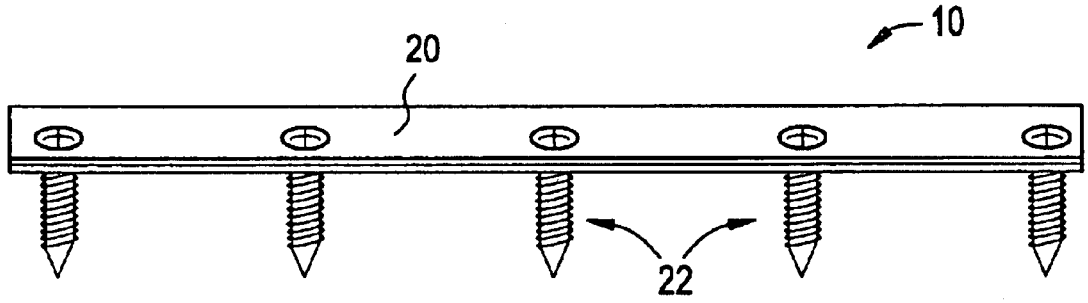
FIG. 2 is a top perspective view thereof with fasteners.
Figure 3:
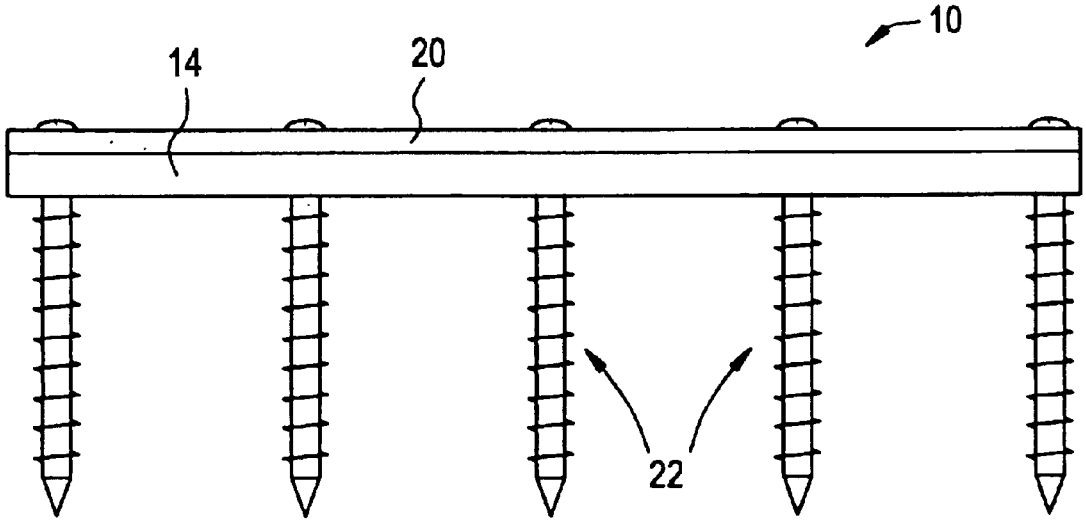
FIG. 3 is a side elevational view thereof with fasteners.
Figure 4:
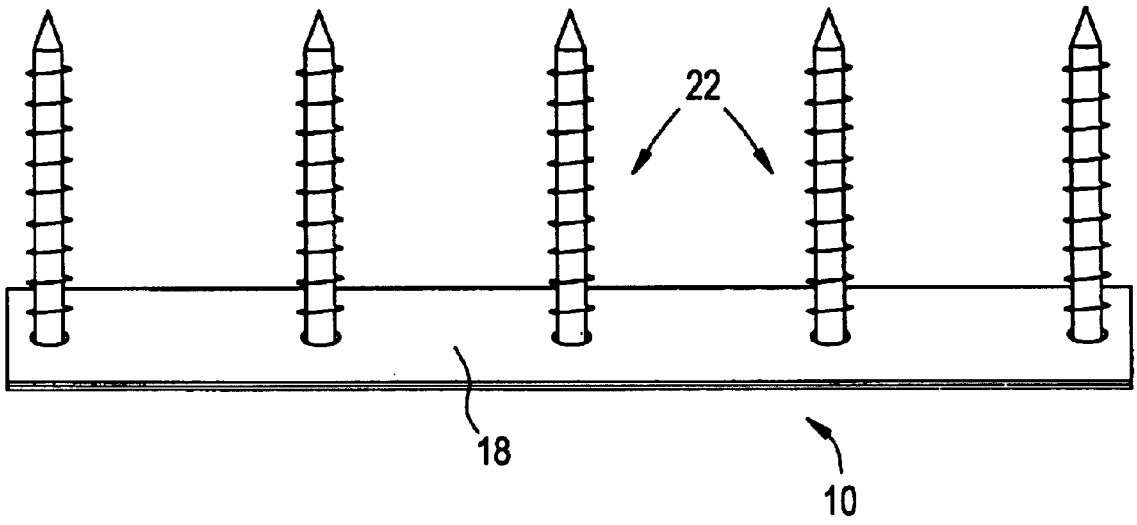
FIG. 4 is a bottom perspective view thereof with fasteners.
Figure 5:
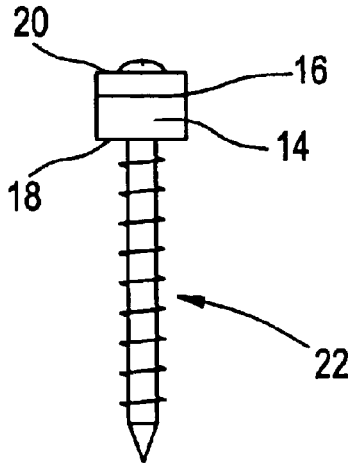
FIG. 5 is an end elevational view thereof with fasteners, the other end being identical thereto.

FIG. 2 shows a top perspective view of the batten bar with fasteners, the fasteners being generally designated at 22. FIG. 3 shows a side elevational view of the batten bar with fasteners, the other side elevational view being identical thereto. FIG. 4 shows a bottom perspective view of the batten bar with fasteners. FIG. 5 shows an end elevational view of the batten bar with fasteners, the other end elevational view being identical thereto.

The batten bar comprises: a metal substrate 14 having a top surface 16, and a bottom surface 18; and a thermoplastic coating 20 covering the top surface of the metal substrate. The metal substrate of the batten bar is stainless steel or non-corroding galvanized metals having a thickness of from about 0.25 mm to 3 mm, while the thermoplastic layer covering the metal substrate has a thickness of from about 0.25 mm to 2 mm and is selected from a group consisting of polyvinyl chloride, thermoplastic olefins, chlorinated polyethylene, chlorosulfonated polyethylene, nylon, ethylene propylene diene rubber or any heat weldable plastic. The batten bar typically has a length of 6' to 8' and a width of 1" to 4".

When the metal substrate of the batten bar is of a soft metal, such as copper or aluminum, this thickness should be about 1 mm to 5 mm or more for providing integrity to the substrate.

The fastener 22 is preferably a metal screw having threads thereon.

Figure 8:
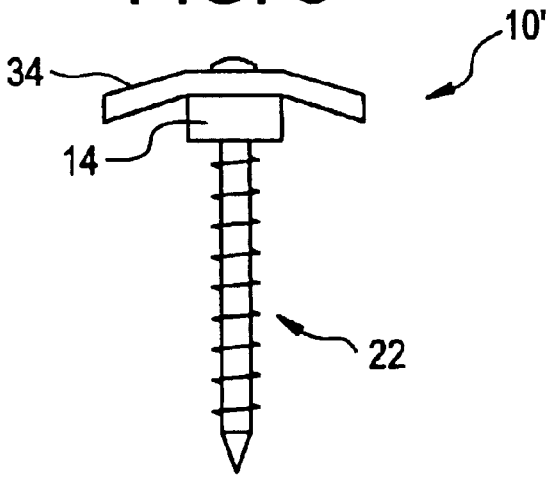
FIG. 8 shows another embodiment of the batten bar with an end view of a batten bar with a fastener wherein the batten bar is equipped with a thermoplastic extension on the top surface thereof and is integral therewith.

FIG. 8 shows an end elevational view of another embodiment of the batten bar 10' equipped with fasteners wherein the metal portion 14 of the batten bar is provided with a thermoplastic extension 34 overlapping metal portion 14 and extending about 1" to 2" on each side thereof. The thickness of the extension is about 2 mm to 4 mm or more.

Figure 7:
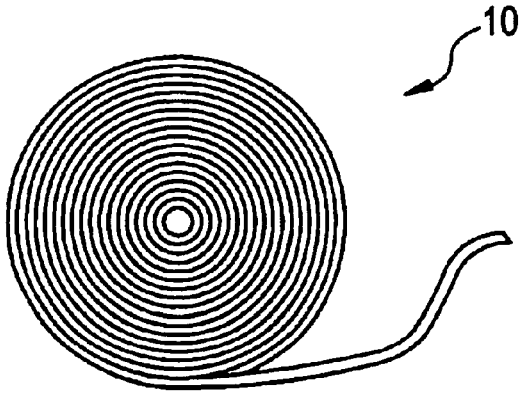
FIG. 7 is a schematic illustration of the batten bar without fasteners rolled into a coil.

For ease of packaging, transportation and handling, the batten bar is rolled into a coil as shown in FIG. 7.

Figure 6:
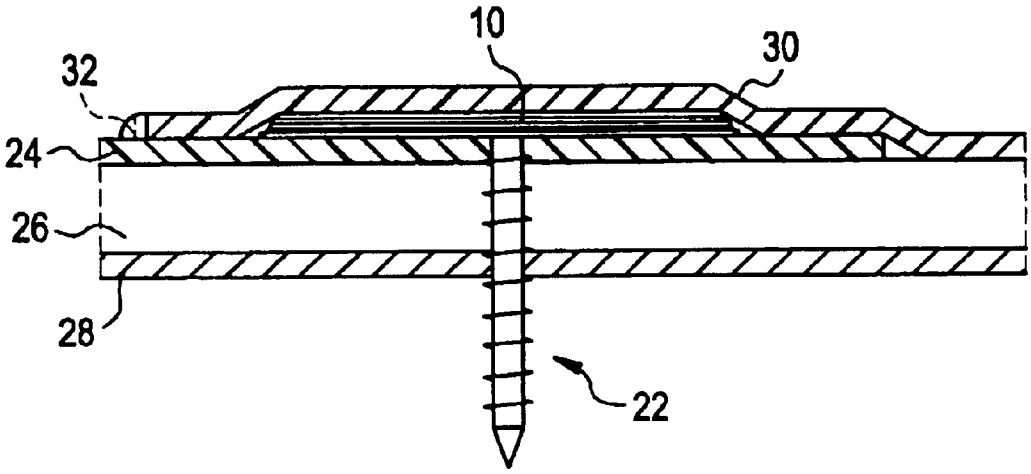
FIG. 6 is a cross-sectional view illustrating the use of the batten bar and a fastener for attaching thermoplastic roof membranes to a roof deck.

FIG. 6 is a cross-sectional view illustrating the use of the batten bar 10 and a fastener 22 for attaching roof membranes to a roof deck. The method of attachment comprises the following steps: lower thermoplastic membrane 24 is positioned over insulation 26 which is over the roof deck surface 28; fastener 22 is inserted through batten bar 10, insulation 26, and into roof deck 28; upper thermoplastic membrane 30 is then lopped over the marginal portions of the lower thermoplastic membrane 24 covering batten bat 10; and upper thermoplastic membrane 30 is secured to the batten bar 10 and the lower thermoplastic membrane 24 by welded seam 32.

In another embodiment, the batten bar can itself be fabricated of a heat weldable, thermoplastic material compatible with the roofing membrane.

| PARTS LIST | |
|---|---|
| Batten bar with fasteners, generally designated | 10 |
| Openings in batten bar | 12 |
| Metal portion of batten bar | 14 |
| Top surface of metal portion | 16 |
| Bottom surface of metal portion | 18 |
| Thermoplastic coating on top surface of metal portion | 20 |
| Fastener, generally designated | 22 |
| Lower thermoplastic membrane | 24 |
| Insulation | 26 |
| Roof deck | 28 |
| Upper thermoplastic membrane | 30 |
| Weld between thermoplastic membranes | 32 |
| Thermoplastic extension on top of batten bar | 34 |

Having described the invention with reference to its preferred embodiments, it is to be understood that modifications within the scope of the invention will be apparent to those skilled in the art.

What is claimed is:

1. A two-piece fastener assembly for securing two thermoplastic roof membranes to an underlying roof deck comprising:

a batten bar of elongated rectangular configuration comprising:

an elongated rectangular metal substrate defined by a top surface and a bottom surface;

a thermoplastic layer covering said top surface of said elongated rectangular metal substrate;

a plurality of openings spaced from each other in said batten bar; and a plurality of fasteners positioned in the plurality of openings in said batten bar, wherein:

the head portions of said plurality of fasteners are substantially in the horizontal plane of a first thermoplastic roof membrane covering an underlying roof deck upon securing said batten bar over a marginal portion of said first thermoplastic roof membrane to said roof deck; and wherein:

a second thermoplastic roof membrane overlaps said batten bar and said marginal portion of said first thermoplastic roof membrane for fusing said second thermoplastic roof membrane to said batten bar and said first thermoplastic roof membrane by application of heat and pressure thereto.

2. The two-piece fastener assembly of claim 1 wherein said elongated rectangular metal substrate is formed of stainless steel or galvanized metals.

3. The two-piece fastener assembly of claim 1 wherein said thermoplastic coating is a material selected from a group consisting of polyvinyl chloride, thermoplastic olefins, chlorinated polyethylene, chlorosulfonated polyethylene, nylon and ethylene propylene diene rubber.

4. The two-piece fastener assembly of claim 1 wherein said fasteners are screw members having threads thereon.

5. A method of securing a first thermoplastic roof membrane to a second thermoplastic roof membrane and securing said first and second thermoplastic roof membranes to an underlying roof deck comprising the steps of:

1) providing a two-piece fastener assembly comprising:

a) a batten bar of elongated rectangular configuration comprising:

an elongated rectangular metal substrate defined by a top surface and a bottom surface;

a thermoplastic layer covering said top surface of said elongated rectangular metal substrate;

a plurality of openings spaced from each other in said batten bar; and a plurality of fasteners positioned in the plurality of openings in said batten bar;

2) placing said first thermoplastic roof membrane on said roof deck;

3) placing said batten bar on a marginal portion of said first thermoplastic roof membrane;

4) inserting said plurality of fasteners through said plurality of openings in said batten bar;

5) threading said plurality of fasteners through said first thermoplastic roof membrane into said roof deck to fasten the thermoplastic roof membrane to the roof deck;

6) placing said second thermoplastic roof membrane to overlap said batten bar and said marginal portion of said first thermoplastic roof membrane; and 7) applying heat and pressure to the overlapped portion of the thermoplastic roof membranes thereby causing a fusion of the second thermoplastic roof membrane to the batten bar and to the first thermoplastic roof membrane to provide a waterproof covering over said roof deck.

6. A two-piece fastener assembly for securing two thermoplastic roof membranes to an underlying roof deck comprising:

a batten bar of elongated rectangular configuration having a length of about 6' to 10' and a width of about 1" to 4" and comprises:

an elongated rectangular metal substrate defined by a top surface and a bottom surface;

a thermoplastic layer covering said top surface of said elongated rectangular metal substrate;

a plurality of openings spaced from each other in said batten bar; and a plurality of metal fasteners having heads and threads thereon positioned in the plurality of openings in said batten bar, wherein:

said heads of said plurality of fasteners are substantially in the horizontal plane of a first thermoplastic roof membrane covering an underlying roof deck upon securing said batten bar over a marginal portion of said first thermoplastic roof membrane to said roof deck; and wherein:

a second thermoplastic roof membrane overlaps said batten bar and said marginal portion of said first thermoplastic roof membrane by application of hear and pressure thereto.

7. The two-piece fastener assembly of claim 6 wherein said elongated rectangular metal substrate is formed of stainless steel or galvanized metals.

8. The two-piece fastener assembly of claim 6 wherein said elongated rectangular metal substrate has a thickness of about 0.5 mm to 5 mm.

9. The two-piece fastener assembly of claim 6 wherein said thermoplastic coating has a thickness of about 0.5 mm to 3 mm and is selected from a group consisting of polyvinyl chloride, thermoplastic olefins, chlorinated polyethylene, chlorosulfonated polyethylene, nylon and ethylene propylene diene rubber.

10. A method of securing a first thermoplastic roof membrane to a second thermoplastic roof membrane and securing said first and second thermoplastic roof membranes to an underlying roof deck comprising the steps of:

1) providing a two-piece fastener assembly comprising:
   a batten bar of elongated rectangular configuration having a length of about 6' to 10' and a width of about 1" to 4" and comprising:
   an elongated rectangular metal substrate defined by a top surface and a bottom surface;
   a thermoplastic layer covering said top surface of said elongated metal substrate;
   a plurality of openings spaced from each other in said batten bar; and
   a plurality of metal fasteners having threads thereon positioned in the plurality of openings in said batten bar for securing said batten bar to a roof deck;
2) placing said first thermoplastic roof membrane on said roof deck;
3) placing said batten bar on a marginal portion of said first thermoplastic roof membrane;
4) inserting said plurality of fasteners through said plurality of openings in said batten bar;
5) threading said plurality of fasteners through said first thermoplastic roof membrane into said roof deck to fasten the thermoplastic roof membrane to the roof deck;
6) placing said second thermoplastic roof membrane to overlap said batten bar and said marginal portion of said first thermoplastic roof membrane; and
7) applying heat and pressure to the overlapped portion of the thermoplastic roof membranes thereby causing a fusion of the second thermoplastic roof membrane to the batten bar and to the first thermoplastic roof membrane to provide a waterproof covering over said roof deck.

* * * * *